US008393261B2

(12) United States Patent
Kollep et al.

(10) Patent No.: US 8,393,261 B2
(45) Date of Patent: Mar. 12, 2013

(54) CAPSULE WITH INTEGRATED PIERCING MEMBER

(75) Inventors: Alexandre Kollep, Lutry (CH); Christophe S. Boussemart, Lugrin (FR)

(73) Assignee: Nestec S.A., Vevey (CH)

( * ) Notice: Subject to any disclaimer, the term of this patent is extended or adjusted under 35 U.S.C. 154(b) by 545 days.

(21) Appl. No.: 12/689,853

(22) Filed: Jan. 19, 2010

(65) Prior Publication Data

US 2010/0180774 A1 Jul. 22, 2010

(30) Foreign Application Priority Data

Jan. 22, 2009 (EP) ..... 09151060

(51) Int. Cl.
*A47J 31/40* (2006.01)
*B65D 81/00* (2006.01)

(52) U.S. Cl. ..... 99/295; 99/323; 426/77; 426/80

(58) Field of Classification Search ..... 99/295, 99/289 R, 302 R, 323; 426/77, 78, 80, 82
See application file for complete search history.

(56) References Cited

U.S. PATENT DOCUMENTS

| | | | | |
|---|---|---|---|---|
| 3,610,461 | A | 10/1971 | Allyn | 220/54 |
| 4,921,712 | A | 5/1990 | Malmquist | 426/77 |
| 5,402,707 | A | 4/1995 | Fond et al. | 99/295 |
| 6,810,788 | B2 | 11/2004 | Hale | 99/295 |
| 6,948,420 | B2 | 9/2005 | Kirschner et al. | 99/295 |
| 7,543,527 | B2 | 6/2009 | Schmed | 99/295 |
| 7,552,672 | B2 | 6/2009 | Schmed | 99/295 |
| 7,604,826 | B2 * | 10/2009 | Denisart et al. | 426/77 |
| 7,981,451 | B2 * | 7/2011 | Ozanne | 426/79 |
| 2005/0150390 | A1 | 7/2005 | Schifferle | 99/295 |
| 2007/0181003 | A1 | 8/2007 | Bardazzi | 99/279 |
| 2009/0047389 | A1 * | 2/2009 | Jarisch et al. | 426/80 |
| 2010/0313766 | A1 * | 12/2010 | Suggi Liverani et al. | 99/295 |
| 2011/0030563 | A9 * | 2/2011 | Doglioni Majer | 99/295 |
| 2011/0045144 | A1 | 2/2011 | Boussemart et al. | 426/80 |

FOREIGN PATENT DOCUMENTS

| | | |
|---|---|---|
| DE | 20 2005 021160 | 5/2007 |
| DE | 10 2007 024579 | 11/2008 |
| EP | 0 512 470 | 11/1992 |
| EP | 1 165 398 | 1/2002 |
| EP | 1 190 959 | 3/2002 |
| EP | 1 604 915 | 12/2005 |
| EP | 1 834 899 | 9/2007 |
| EP | 1 847 481 | 10/2007 |
| WO | WO 94/02059 | 2/1994 |
| WO | WO 95/09775 | 4/1995 |
| WO | WO 2005/020768 | 3/2005 |
| WO | WO 2005/090196 | 9/2005 |
| WO | WO 2006/030461 | 3/2006 |
| WO | WO 2009/006374 | 1/2009 |

OTHER PUBLICATIONS

European Search Report, EP 09 15 1060.2, mailed Jul. 23, 2009.
European Search Report, EP 09 15 1149.3, mailed Jun. 8, 2009.

* cited by examiner

*Primary Examiner* — Reginald L Alexander
(74) *Attorney, Agent, or Firm* — Winston & Strawn LLP

(57) ABSTRACT

The present invention proposes a capsule for containing beverage ingredients. The capsule includes a sealed ingredients compartment, an inlet face, an outlet face, and an opening member which is positioned at the inlet face outside the compartment and which is provided with piercing members directed towards the ingredients compartment.

19 Claims, 7 Drawing Sheets

CAPSULE WITH INTEGRATED PIERCING MEMBER

FIELD OF THE INVENTION

Figure 1A:
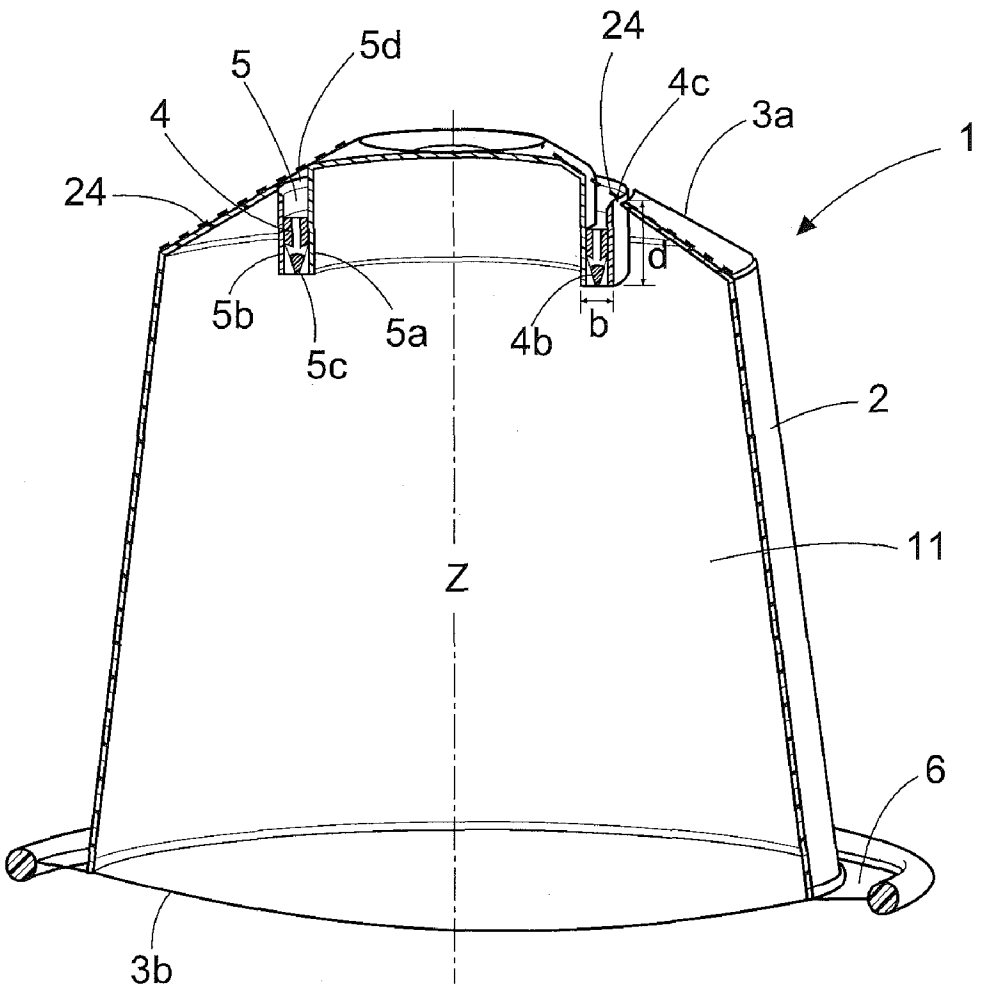

The present invention generally relates to the field of production of beverages or other liquid comestibles on the basis of the ingredients contained in a capsule. In particular, the invention relates to such a capsule comprising an integrally formed piercing member.

BACKGROUND OF THE INVENTION

The background of the present invention is the field of capsules which contain beverage or other comestibles ingredients. By means of an interaction of these ingredients with a liquid, a beverage such as coffee, tea or other comestibles, such as for example soup, can be produced. The interaction can be based on the principle of extraction of a beverage substance, the mixing or the dissolution, in presence of a liquid diluent such as water.

The capsule of the invention is more particularly adapted to contain ground coffee in order to produce a coffee beverage by injecting hot water under pressure into the capsule and obtaining a coffee beverage from the capsule.

Systems and methods for obtaining fluid comestibles from substances containing capsules are for example known from EP 512 470 A.

The principle of the extraction process as described in the prior art can be summarized as follows.

An initially sealed capsule is inserted in a dedicated chamber of the system in which water injection means are provided which enable water to be provided to the capsule, e.g., by injection. In the chamber, dedicated opening means are provided which generate at least one opening in a first wall of the capsule. Accordingly, water entering the capsule through the opening in a first wall is made to interact with ingredients contained in the capsule while traversing the interior of the capsule and is then made to leave the capsule through at least one opening/perforation created in a second wall of the capsule. As a result of the interaction between water and the ingredients in the capsule, a beverage or other comestible can be produced.

The capsule can be gas-tightly closed before use to ensure the freshness of the ingredients within a given shelf life. The capsule can also just form a closed but not necessarily a gas-tight enclosure and be packed in a gastight package individually or in group.

Therefore, the capsules can be closed by, at least, liquid-impermeable walls, preferably liquid- and gas-impermeable walls, at least one of which is pierced only during use, for injection of water, for example, when the capsule is introduced in the device.

In the known beverage preparation devices, the capsule is pierced by introduction of a piercing member which is foreign to the capsule, i.e. the piercing member is provided at the beverage preparation device. In general, an outer wall of the capsule is pierced by introducing the piercing member in the outer wall. Accordingly, a liquid can be injected into the capsule through the holes or apertures generated in the outer wall of the capsule.

However, the known embodiments suffer the disadvantage that certain capsules can be difficult to pierce in a repeated manner. Especially with capsules comprising plastic walls, the material can be relatively difficult to pierce and the piercing members of the device may become blunt relatively rapidly. Therefore, new capsules can no longer be pierced and the beverage preparation device has to be returned to a service or maintenance station for repairing or replacing the piercing members.

Moreover, the piercing means of the known devices only provide a single injection pattern in the capsule. It is therefore not possible to vary the manner the liquid is injected into the capsule, such as the number of holes produced in the body of the capsule, the direction of the injection, the depth of the injection, etc., unless a specific injection commuting system as described in WO 2005/020768 is provided at the device which however can be more complex to produce.

The known devices further suffer the disadvantage that when the capsules are removed from the device, the piercing members of the device disengage from the capsule at the same time. As a result, large holes in the capsule provide a potential leakage from beverage residues such as coffee solids. A known solution for this problem is the provision of filter means in the capsule which prevent the exit or draining of such residues such as proposed in EP 1 165 398. However, this solution requires the provision of an additional element in contact with the beverage ingredients within the ingredient compartment of the capsule. Therefore, the additional element must be made of a food grade and usually inert material. The filter must also be sealed on the inner surface of the capsule and therefore be compatible in sealing with the material of the body of the capsule. Accordingly, it is relatively difficult to find a corresponding material fulfilling all the required features.

Another disadvantage of the prior art opening means is that the piercing member generally comes in contact with the ingredients provided within the capsule when piercing a wall or a face of the capsule. This is particularly disadvantageous for certain ingredients such as infant formula for which it is necessary to clean or sanitize the piercing member after each cycle such as described in PCT/EP08/057,979.

WO 2006/030461 relates to a capsule which comprises a piercing element turned upwards in direction of an outer membrane. Hence, the piercing element is facing the outer membrane of the capsule from inside. Accordingly, piercing of the membrane of the capsule is obtained by fluid pressure which presses the membrane against sharp elements provided within the capsule. However, this solution has several drawbacks. In particular, the membrane may easily be ruptured by accident. Hence a user may hurt him/herself due to the sharp protruding piercing members facing the exterior of the capsule. Moreover, if the membrane is pierced before use of the capsule, this may cause a rapid degradation of the ingredients.

The present invention therefore aims at providing a solution to the above-described problems. The invention also aims at other objects and particularly at providing solutions to other problems as will appear in the rest of the present description.

SUMMARY OF THE INVENTION

In a first aspect, the present invention proposes a capsule for containing beverage ingredients comprising a sealed ingredients compartment, an inlet face and an outlet face, the capsule further comprising opening means which are positioned, at the inlet face, outside the ingredients compartment and which are provided with at least one piercing member directed towards the ingredients compartment. Preferably, a plurality of piercing members directed are provided for piercing the inlet face and having a size sufficient to extend into the ingredients compartments to facilitate entry of the liquid therein.

A capsule according to the present invention can be used in conjunction with a dedicated beverage preparation device or beverage system in order to enable a beverage preparation by interaction with liquid, provided in the capsule, and the beverage ingredients; the interaction taking place within the ingredients compartment of the capsule. Thereby, the opening means with at least one piercing member provided outside of the ingredients compartment of the capsule enables a piercing actuation by a dedicated actuation member of a beverage preparation device.

With a capsule according to the present invention, a reliable opening mechanism for each capsule can be provided as the opening means are formed as a part or parts of the capsule. Accordingly, even capsules made of materials which are difficult to pierce such as those of plastics, e.g. polypropylene plastics, can effectively be pierced as the piercing member is only to be used once and is therefore not subjected to wearing effect.

It should be understood that the capsule can comprise opening means of different designs depending on the type of ingredients contained in the capsule and/or on the beverage to be produced from the capsule. Hence, it is possible to adapt the piercing mode to the type of ingredients in the capsule and/or beverage to be produced. Accordingly, the versatility of the system can be increased.

The opening means of the capsule can be held within at least one recess provided in the body of the capsule. In a mode, the recess is an annular groove protruding inside the ingredients compartment of the capsule. Accordingly, the mechanical guidance of the opening means can be assured by means of the capsule itself without need for external guiding means. Furthermore, the opening means is at least partially hidden in the capsule for avoiding accidental/manual piercing of the capsule. It should be noted that the recess may as well be of different geometrical shape suitable for housing opening means according to the present invention. Moreover, more than one recess may be provided at the capsule for housing the opening means.

The recess for housing the opening means can be covered by a membrane or a dedicated cover member in order to hide the piercing member. Therefore, the risk of accidental opening of the capsule can be further reduced.

Due to the fact that the opening means, including the at least one piercing member, are provided outside the compartment and within a recess of the capsule, dedicated actuation means of a beverage preparation device to be used with the capsule can be maintained out of contact of the ingredients housed within the compartment. Accordingly, a more hygienic system can be provided and cross-contamination of the beverages to be prepared can be effectively prevented.

The opening means are preferably movably arranged within the annular recess. In a possible mode, the opening means is initially secured within the recess. In this regard, the opening means is connected within the recess by press fitting or clipping. Furthermore, a dedicated support or at least one position member can be arranged within the recess of the capsule to support the opening means. Accordingly, unnecessary movement of the opening means during transportation of the capsule is effectively prevented due to the connection of the opening means within the recess.

In a preferred embodiment, the opening means is configured in the recess in a manner to slide upon a certain pressure being exerted on the opening means, e.g. by a mechanical means provided at the device to be used in conjunction with the capsule. Accordingly, it is possible to provide an actuation member at a dedicated beverage preparation device which is suitable to exert a predefined force or pressure onto the opening means in order to overcome the frictional forces of the press-fitting arrangement supporting the opening means within the recess of the capsule and hence, move the opening means towards the ingredients compartment and pierce the ingredients compartment by means of the piercing means of the opening means.

In a preferred embodiment, the opening means is a piercing element comprising at least one piercing member formed as a part which is preferably of different material than the body of the capsule. However, the opening means and the capsule may as well be formed of the same material.

The body of the capsule is preferably made of injected or thermoformed plastic such as PP or PA, or metal. In particular, plastics such as PP with one or more gas barrier layers (e.g., EVOH, metal) can be used.

The opening means are preferably made of hard plastics such as PP, PET, Polycarbonate or PA, or metal. Hence, effective piercing of the capsule body respectively the ingredients compartment is enabled by the piercing means.

In a preferred embodiment, the opening means comprise a base ring and piercing members formed of several piercing blades or spikes. Thereby, the piercing blades or spikes can be of variable shape suitable for piercing the ingredients compartment of the capsule depending on the material and/or thickness of the capsule to be pierced and/or desired water injecting pattern. Accordingly, holes or apertures of different shapes and cross sections can be created in the ingredients compartment through which liquid can be injected. Furthermore, the base member of the opening means can be formed as a partial or full ring with the piercing members spaced along the periphery of the partial or full ring.

The opening means can be made of a monolithic piece or of several pieces which are inserted in the recess of the capsule. In particular, the piercing means can be formed of a crown-shaped base portion provided with piercing members such as several blades or spikes.

In another mode, the opening means may comprise several arc-shaped segments which comprise piercing blades or spikes and which are distributed in the recess of the capsule. Thereby, resurgence of solid residues exiting the piercing holes generated at the inlet face of the capsule due to the opening means is blocked by the crown-shaped portion or arc-shaped segments of the opening means which close the recess or groove even after removal of the capsule from the device. Hence, coffee grounds or liquid can effectively be prevented from resurging from the injection holes when the capsule after use.

The opening means may further comprise inner flow channels for establishing a dimensionally controlled liquid flow-path between the inlet face of the capsule and the ingredients compartment. Accordingly, liquid provided from the device at the inlet face of the capsule can be effectively injected in the ingredients compartment according to a more controlled injection pattern via the inner flow channels.

In a preferred embodiment, the inner flow channels comprise outlet apertures which are designed to direct liquid provided to the flow channels in the ingredients compartment. Accordingly, it is possible to influence the liquid distribution inside the ingredients compartment of the capsule and thus, to adapt the liquid distribution to the nature of ingredients provided within the capsule and/or the beverage to produce. For example, the flow channels can be arranged to be essentially perpendicular to the capsule axis and the outlet apertures are arranged to direct the liquid in the channels in at least one radial direction relative to the channels for mixing with the beverage ingredients in the compartment.

In a possible mode, the inner flow channels are designed with outlet apertures which are distributed to direct the liquid injected into the compartment in at least one radial direction relative to the main direction of the channels. Accordingly, liquid can be distributed in the ingredients compartment more homogeneously across the whole cross section of the compartment.

In a preferred embodiment, the opening means comprise valve means which is designed to open or close the inner flow channels of the opening means or the recess of the capsule as a response to a pressure and/or force being exerted thereon. In particular, the valve means can be a one-way valve such as a rubber elastic sealing gasket which opens when the piercing member is pushed or pressed down and/or water is injected in the recess and which closes the recess or channels when the pressure on the opening means is released. As a result, significantly less or no liquid is released from the capsule when it is removed from the beverage preparation device after use.

Preferably, the opening means of the capsule are designed to interact with dedicated mechanical or physical actuation means provided by a dedicated beverage preparation device to be used in combination with the capsule according to the invention. Accordingly, a simple and efficient opening mechanism of the capsule is provided.

After use, i.e. after the preparation of the beverage, the capsule is disposed with its dedicated opening means. Therefore, no cleaning or sanitizing of the piercing member is required. This is particular advantageous for sensitive ingredients, e.g. milk or infant formula.

The capsule according to the invention can contain ground coffee, ground coffee, tea, herbal tea, cocoa, chocolate, milk powder, soup, nutritional ingredients like infant or toddler formula, etc.

In a second aspect, the present invention relates to a system for preparing a beverage from a food substance contained in an ingredients compartment of a rigid capsule by injection of a liquid into the capsule, the system comprising a device which has at least one enclosing member connected to a closing mechanism for selectively enclosing the capsule in the receiving chamber of the device, the device further comprising a liquid reservoir, a pump connected to the liquid reservoir for supplying liquid to the receiving chamber, and dedicated actuation means connected to the enclosing member for actuating the opening means provided at an inlet face of the capsule, wherein the opening means comprise piercing means directed towards an ingredients compartment of the capsule.

Moreover, the device according to the invention comprises a control unit for controlling at least the operation of the pump of the device and a heating unit connected to the liquid reservoir and the pump of the device. Accordingly, heated pressurized liquid can be provided to the receiving chamber of the device and thus, to the capsule enclosed by the enclosing member.

Preferably, the actuation means of the device comprise a pushing member being designed to actuate the opening means of the capsule. In particular, the pushing member is designed to engage in an annular recess of the capsule in which the opening means of the capsule are inserted. Thereby, the pushing member is designed to exert a pressure on the opening means in order to have the ingredients compartment of the capsule pierced.

The pushing member can be a member arranged fixedly at the enclosing member of the device to exert a pressure when the enclosing member engages the capsule in the receiving chamber of the device. However, the pushing member may be as well engaged by a separate actuation after enclosing of the capsule by the enclosing member.

The pushing member has preferably a cylindrical shape which engages in the annular recess of the capsule.

In a possible embodiment, the pushing member has a cutting or piercing edge to be able to pierce or cut capsules of the prior art, i.e. capsules which have no opening means according to the present invention, e.g. aluminum capsules.

In another possible embodiment, the opening means of the capsule are pushed by effect of a fluid exerting a pressure from outside of the capsule onto the inlet face of the capsule. Hence, no mechanical pushing member is necessary to enable an interaction of the device and the opening means of the capsule. The actuating fluid may be a gas such as compressed air and/or a liquid such as pressurized hot water.

Moreover, the beverage production device may as well comprise a capsule holder comprising one or more puncture elements, e.g. a network of pyramids in order to tear a foil member provided at the outlet face of the capsule as described in EP0512470.

In an alternative embodiment, the capsule itself comprises liquid delivery opening means such as described in EP1604915.

BRIEF DESCRIPTION OF THE DRAWING FIGURES

Further features, advantages and objects of the present invention will become apparent for a skilled person when reading the following detailed description of the embodiments of the present invention, when taken in conjunction with the figures of the enclosed drawings.

FIG. 1*a* shows a preferred embodiment of a capsule according to the present invention in sectional side-view, in which the opening means are in their original position.

Figure 1B:
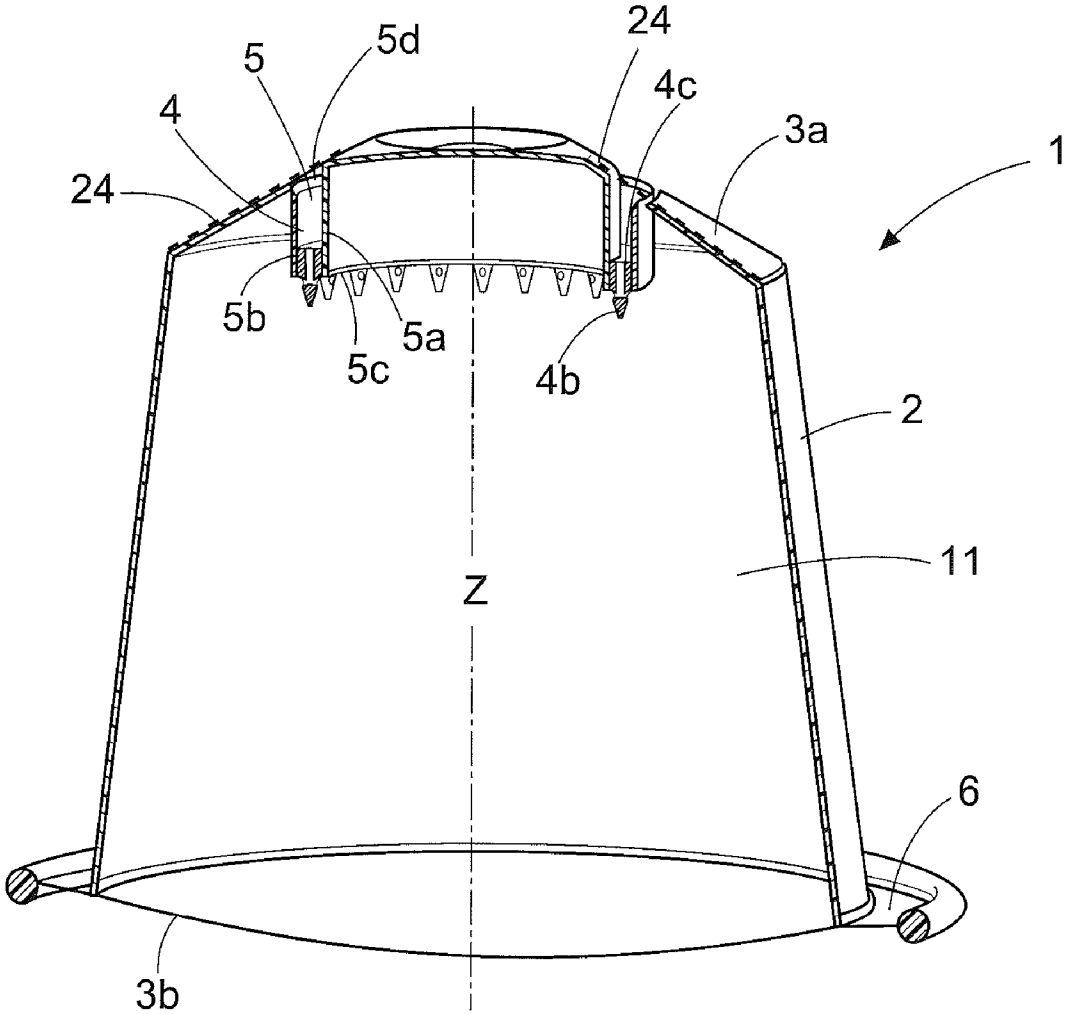

FIG. 1*b* shows the capsule according to FIG. 1*a*, wherein the opening means pierces an outer wall of the ingredients compartment.

Figure 2:
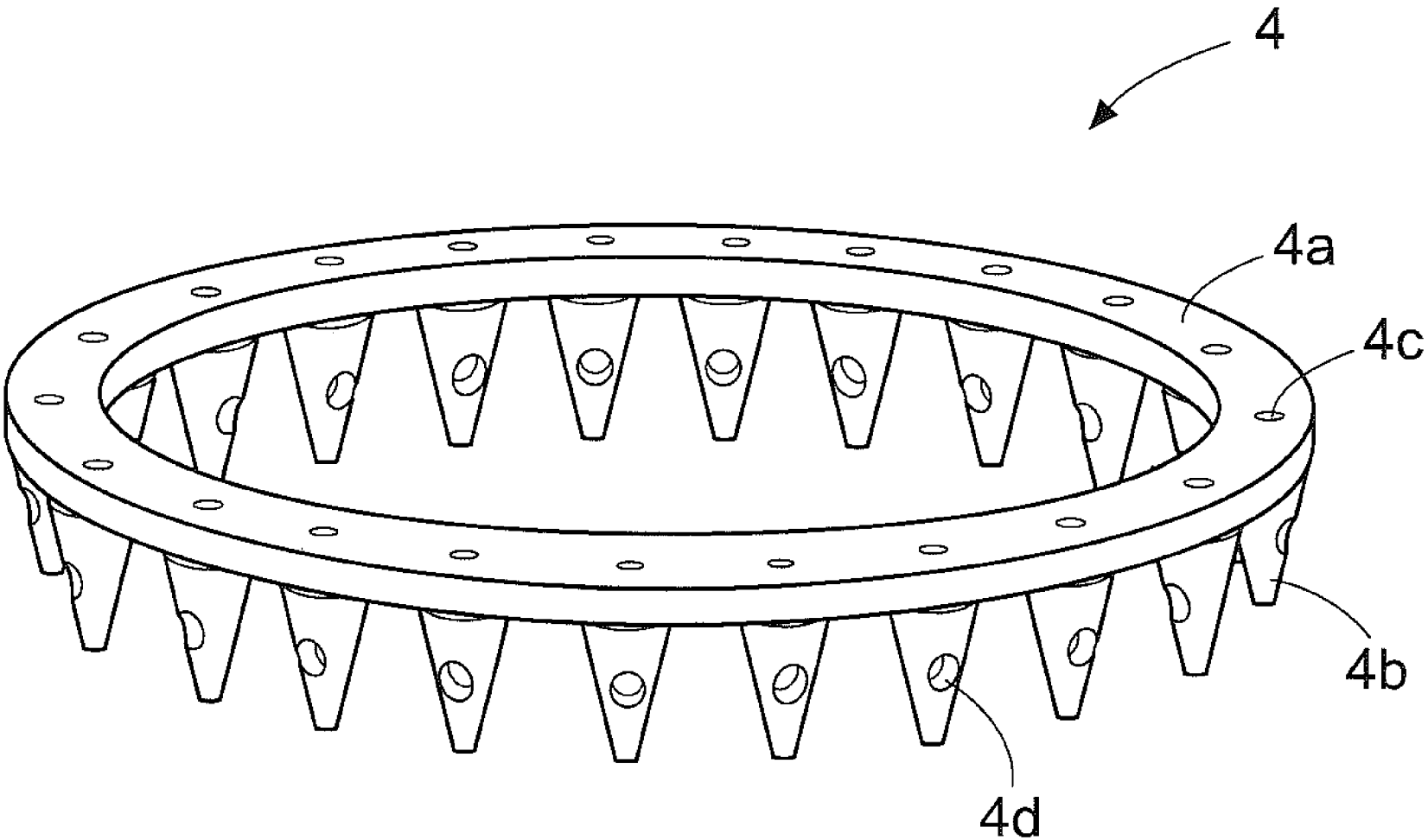

FIG. 2 shows a preferred embodiment of opening means according to the present invention in perspective side-view.

Figure 3A:
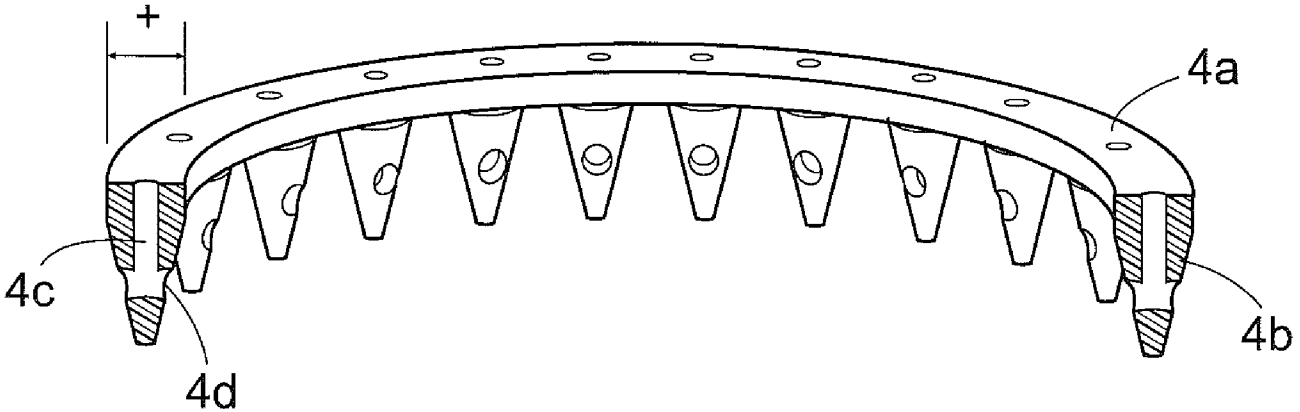

FIG. 3*a* shows a sectional side-view of the opening means according to FIG. 2.

Figure 3B:
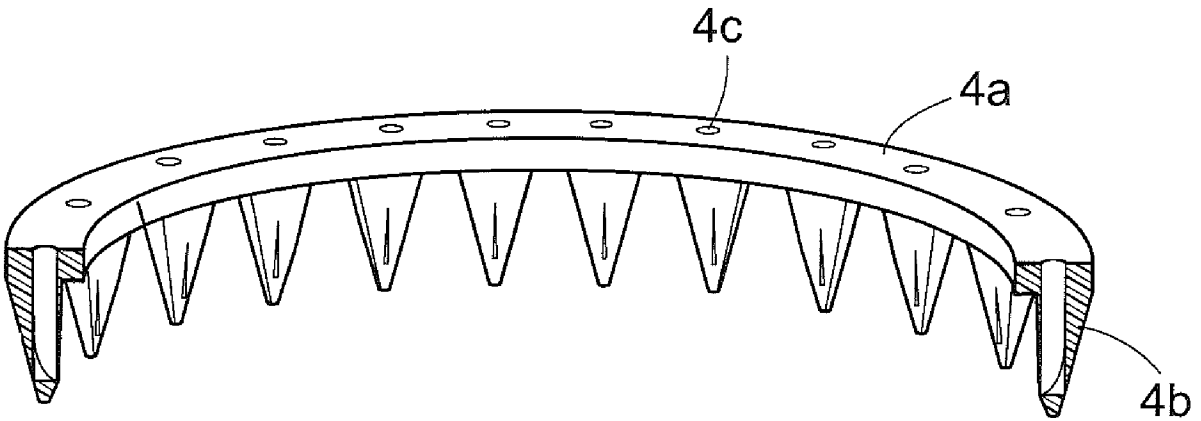

FIG. 3*b* shows another preferred embodiment of the opening means according to the present invention in sectional side-view.

Figure 4A:
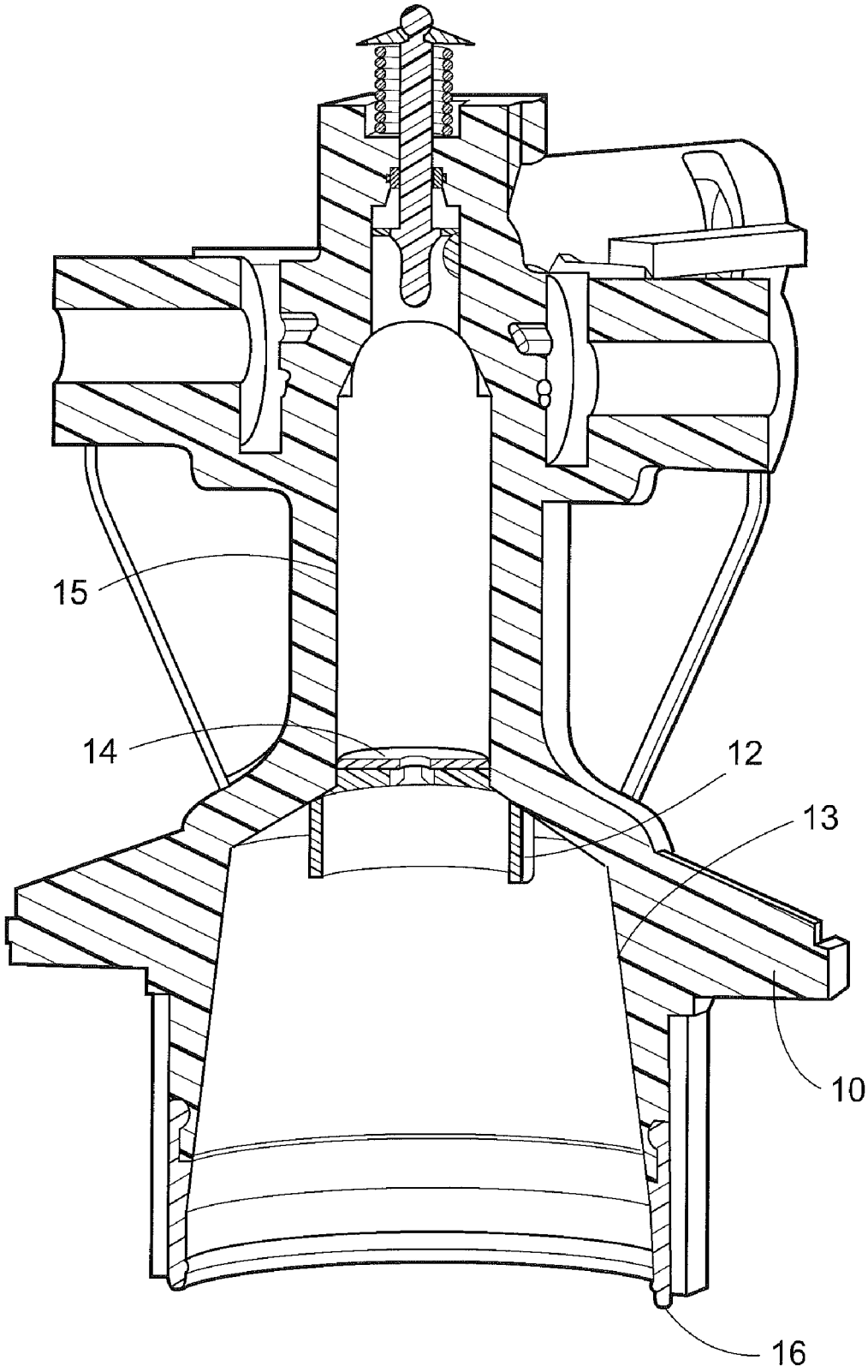

FIG. 4*a* shows an enclosing member of a beverage preparation device according to the present invention in sectional side-view.

Figure 4B:
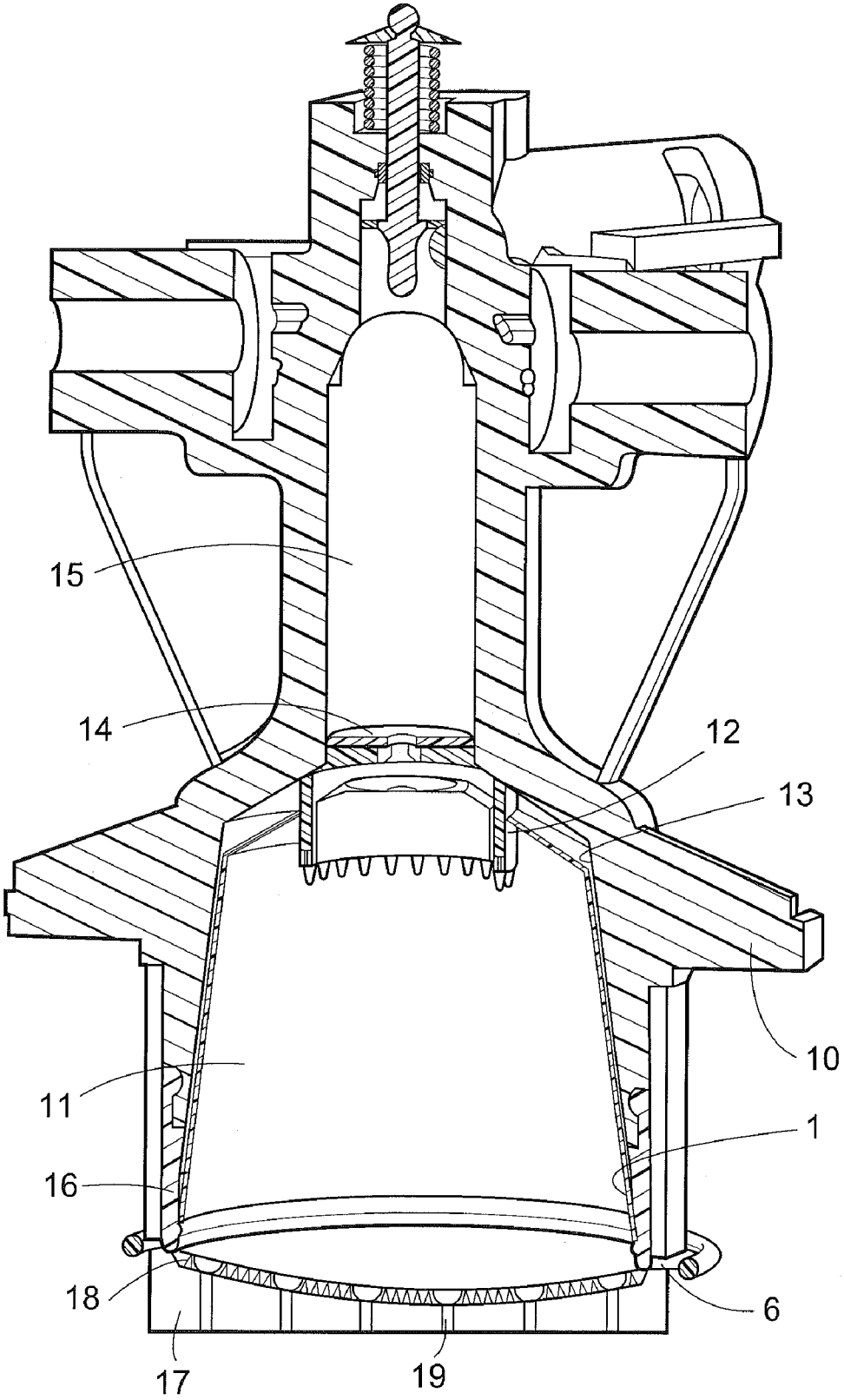

FIG. 4*b* shows the enclosing member according to FIG. 4*a*, wherein the actuation member of the enclosing member of the device is interacting with opening means of the capsule according to the invention.

Figure 5A:
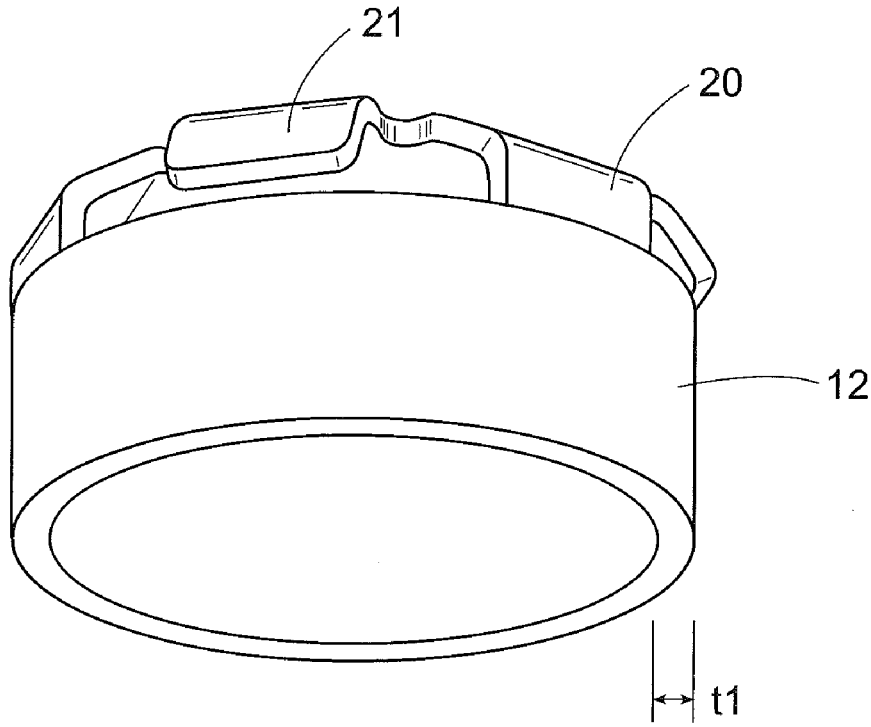

FIG. 5*a* shows a preferred embodiment of a pushing member of a device according to the present invention in a perspective side-view.

Figure 5B:
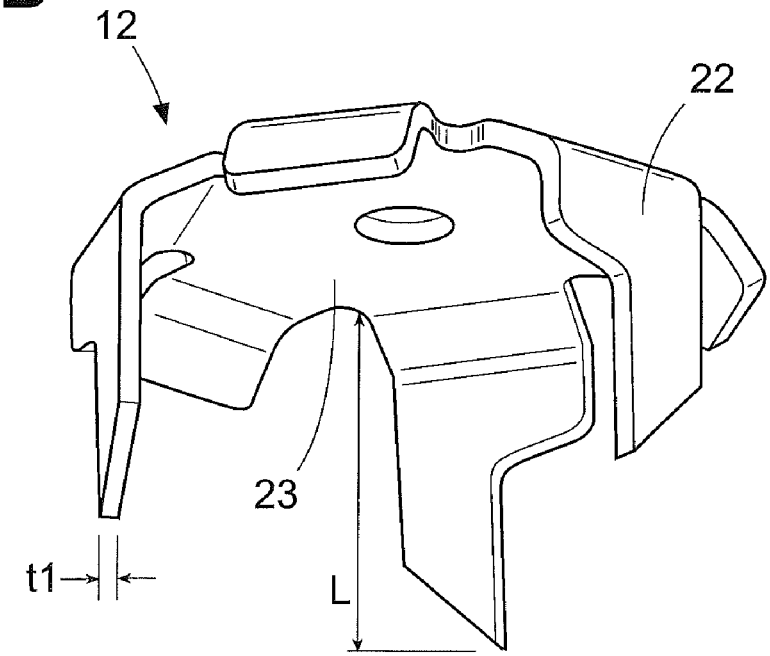

FIG. 5*b* shows a preferred embodiment of a pushing member being equipped with blades and suitable for opening prior art capsules having an aluminum or plastic body portion.

DETAILED DESCRIPTION OF THE PREFERRED EMBODIMENTS

FIG. 1*a* shows a sectional side-view of a capsule 1 according to the present invention which comprises a rigid body 2, an inlet face 3*a* and an outlet face 3*b*. Preferably, the inlet face 3*a* and the rigid body 2 are formed as an integral part of the same material. The rigid body 2 can be made of plastics by injection molding for example. Moreover, the rigid body 2 and the inlet face 3*a* can be made of metal such as for example aluminum.

The outlet face 3*b* is preferably made of a thin aluminum foil sealed to the body of the capsule 2 at the outer rim portion 6 of the capsule. Due to the outlet face 3*b* being sealed to the capsule in an airtight manner, a hermetically sealed capsule is obtained.

The capsule body 2 and the outlet face 3*b* enclose an ingredients compartment 11. Therein, ingredients, such as coffee powder (e.g., roast and ground coffee), tea and/or milk powder can be contained in the compartment.

At the inlet face 3*a* of the capsule, a recess 5 is provided which protrudes inside the ingredients compartment 11 as can be seen in FIG. 1*a*. Preferably, the recess 5 is of annular form, e.g., with a U-shaped cross section, and is concentrically arranged to the rotational axis Z of the capsule 1.

The recess comprises an inner wall 5*a* and an outer wall 5*b* which are arranged concentrically to each other at a distance b. Accordingly, the recess 5 is of a predefined width b. Preferably, the values for the width b lie in the range of 0.2 to 0.8 cm.

Moreover, the recess 5 comprises a lower bottom portion 5*c* which is arranged with respect to an upper edge 5*d* of the recess at the depth d. Preferably the values for the depth d are within the range of 0.3 to 1.5 cm.

The inner side wall portion 5*a*, the outer side wall portion 5*b* and the bottom portion 5*c* of the recess 5 are formed as integral parts of the capsule body 2. Thereby, the bottom portion 5*c* of the recess 5 may be of a thinner thickness than the rest of the body of the capsule or may have localized weakening areas. However, preferably, the body of the capsule 2 is of the same thickness and hence, the side wall portions 5*a*, 5*b* and the bottom portion 5*c* are preferably of the same thickness as the rest of the body 2 of the capsule.

Inside the recess 5, capsule opening means 4 are housed. Thereby, the opening means 4 are preferably complementary formed to the recess. Accordingly, the opening means 4 are arranged concentrically to the central axis Z of the capsule 1.

As illustrated in FIG. 2, the opening means 4 is preferably formed as an opening member having a ring- or crown-shaped base portion which is provided with a plurality of piercing members 4*b* suitable for piercing the bottom portion 5*c* of the recess 5 and thus, suitable for piercing and accessing the ingredients compartment 11 of the capsule.

In its original position, the opening means 4 are guided by the side walls 5*b* and 5*a* of the recess such that the motion of the opening means 4 with respect to the capsule body 2 is guided in a direction parallel to the axis Z of the capsule. Accordingly, the opening means 4 are preferably slidably arranged within the recess 5.

However, the opening means 4 may as well be press-fitted into the recess 5 such that the motion of the opening means 4 with respect to the capsule body 2 is only obtainable by a pressure being exerted on the opening means 4 to overcome the friction forces between the opening means 4 and the recess 5.

In the preferred embodiment, the inlet face 3*a* of the capsule may be covered by an additional membrane 24 (see FIGS. 1*a* and 1*b*) which preferably particularly covers the recess 5 of the capsule 1. Accordingly, a tamper-evident cover is provided to the capsule 1. Hence, a user may be able to see if a capsule has already been used or if the inlet face has been damaged.

The opening means 4 preferably comprise a plurality of inner flow channels 4*c* which are provided in the piercing members and which extend to the base ring portion 4*a* of the opening means. Thereby, the inner flow channels 4*c* are connected to outlet apertures 4*d* provided at the piercing members 4*b* of the opening means. For instance, the apertures 4*d* are directed radially relative to the direction of the flow channels.

As can be seen in FIGS. 1*a* and 1*b*, the opening means are arranged with the piercing members 4*b* in direction of the bottom portion 5*c* of the recess 5 and thus, towards the ingredients compartment 11 of the capsule 1.

It should be understood that the opening means 4 may be made to slide within the recess 5 by a force being exerted thereon suitable to overcome the frictional forces between the opening means 4 and the side portions 5*a* and 5*b* which are due to the opening means 4 being press fitted in the recess 5.

Therefore, dedicated actuation means may be provided at a device to be used with the capsule, which are able to exert a force onto the opening means 4 in a direction parallel to the central axis Z of the capsule 1. It should be understood that such dedicated actuation means of a device may be any mechanical or physical means suitable for interacting with the opening means 4.

Hence, in case the opening means 4 are moved relatively to the body 2 of the capsule 1 such that the bottom portion 5*c* of the recess 5 is pierced by the piercing members 4*b* of the opening means 4, the piercing members 4*b* protrude into the ingredients compartment 11 as shown in FIG. 1*b*. Accordingly, the outlet apertures 4*d* of the piercing means 4*b* are protruding into the ingredients compartment 11 and thus, liquid provided to the recess 5 is able to flow through inner flow channels 4*c* of the opening means 4 to the ingredients compartment 11.

It should be noted that the piercing members 4*b* of the opening means may as well be designed to comprise no inner flow channels 4*c*. Accordingly, the opening means are only designed to pierce the bottom portion 5*c* of the recess 5 and thus the ingredients compartment 11 in case a force or pressure is exerted thereon. Hence, the liquid provided to the recess 5 by a dedicated beverage preparation device bypasses the opening means and flows through the apertures of holes created in the bottom portion 5*c* by the piercing means 4*b* into the ingredients compartment.

FIG. 2 shows an embodiment of the opening means 4 in perspective side view. As can be seen in FIG. 2, the opening means 4 comprises the opening member having a ring- or crown-shaped base member 4*a* and a plurality of protruding blades or spikes 4*b*.

It should be understood that instead of a single crown-shaped base member, the opening means 4 may as well comprise at least two arc-shaped base elements 4*a* which are equipped with blades or spikes 4*b*.

The outlet apertures 4*d* of the piercing members 4*b* are preferably provided through the side portions of the spikes 4*b* as can be seen in FIG. 3*a*. Accordingly, water introduced at the inner flow channels 4*c*, can be redirected by the outlet apertures 4*d* and can thus be distributed in a predefined manner within the ingredients compartment 11 of the capsule 1. Thereby, the diameter of the outlet apertures 4*d* and the inner flow channels 4*c* can be dimensioned accordingly in order to influence the pressure of the liquid injected to the ingredients compartment 11.

It should be understood that the amount of inner flow channels 4*c* and thus, the amount of spikes or blades 4*d* provided at the base ring portion 4*a* can be varied in order to provide a dedicated injection pattern for different capsules containing ingredients of different nature.

As shown in FIG. 3*a*, the ring-shaped member 4*a* is of a predefined width t, which is preferably slightly larger than the width d of the annular recess 5 of the capsule 1. Accordingly, a press fitting of the opening means 4 within the recess 5 is obtained. Moreover, after use of the capsule 1, the base ring-shaped member 4*a* closes the recess 5, preferably, in a liquid-tight manner. Hence, no resurgence of liquid and/or solid residues such as coffee particles through the pierced holes or apertures at the inlet face of the capsule occurs.

It should be understood that different opening means 4 can be provided in the recess 5. Hence, the injection parameters can be adapted to certain needs.

FIG. 3*b* shows another preferred embodiment of the opening means according to the invention. Therein, the inner flow channels 4*c* are of different shapes, e.g., triangular shapes. Moreover, the outlet apertures 4*d* formed in the blades 4*b* comprise a thicker opening at a lower portion of the opening means than at the upper portion thereof. Accordingly, a different injection pattern can be realized.

It should be noted that the inner flow channels 4*c* and the outlet apertures 4*d* may be of different geometrical form and size in order enable an improved injection pattern.

FIG. 4*a* shows a preferred embodiment of an enclosing member 10 of a beverage preparation device to be used with the capsule according to the invention. Thereby, the enclosing member 10 comprises a bell-shaped receiving chamber 13 which is preferably complementary formed to the body 2 of the capsule 1.

The enclosing member 10 is preferably connected to a closing mechanism (not shown) of the device for selectively enclosing a capsule in the receiving chamber 13 of the device. In particular, as illustrated in FIG. 4*b*, the closing mechanism enables a relative movement of the enclosing member 10 and a capsule holder 17 of the device in order to enclose the capsule 1 in the receiving chamber 13.

At a lower portion of the enclosing member 10 sealing means 16 are provided in order to interact with the rim portion 6 of the capsule 1 and the capsule holder 17 in order to enable a fluid-tight sealing engagement of the capsule 1 during the enclosure of the capsule as shown in FIG. 4*b*.

At an upper portion of the enclosing member 10, actuation means 12 are protruding into the receiving chamber 13.

The actuation means 12 may be a static protruding pushing member which is suitable to engage in the recess 5 of the capsule 1 during the relative movement of the enclosing member 10 and the capsule 1. However, the actuation means 12 may as well be connected to a connection member 14 which is in turn connected to a lever mechanism of the device (not shown) and which is suitable for enabling a relative movement of the actuation means 12 and the enclosing member 10. In particular, the actuation means 12 may be an actuation member preferably of cylindrical shape suitable for engaging in the annular recess 5 of the capsule 1 provided to the enclosing chamber 13.

Moreover, the device preferably comprises a liquid reservoir, heating means, such as an inline heating device, and a pump which are connected to liquid supply channel 15. The liquid supply channel 15 is connected to the enclosing member 10. Hence, heated pressurized liquid can selectively be provided to the receiving chamber 13.

FIG. 4*b* shows the enclosing means 10 of FIG. 4*a*, wherein a capsule 1 according to the present invention is provided to the bell-shaped enclosing chamber 13. Thereby, the enclosing member 10 assumes a closed position, i.e., the lower sealing portion 16 of the enclosing member 10 is pressed against the capsule holder 17. Thereby, the rim portion 6 is enclosed there between as shown in the figure. Accordingly, the receiving chamber 13 housing the capsule 1 is sealed in a fluid-tight manner.

Due to the relative movement of the enclosing member 10 and the capsule holder 17, the protruding pushing member 12 is engaged within the recess 5 of the capsule, thereby exerts a downwardly acting force onto the opening means 4 supported therein. Accordingly, the opening means 4 are pushed towards the ingredients compartment 11 of the capsule 1 in order to puncture the lower portion 5*c* of the recess 5 to open the compartment 11 for enabling liquid to be supplied in the compartment. Thereby, the complementary shape of the receiving chamber 13 and the capsule body enable a correct positioning of the pushing member 12 with respect to the recess 5 of the capsule 1.

As shown in FIG. 5*a*, the thickness t1 of the cylindrical shaped pushing member 12 is preferably slightly lower, e.g. 10 to 20% lower, than the width b of the recess 5. Accordingly, blocking of the recess 5 due to the pushing member 12 is prevented. Hence, liquid injected into the receiving chamber 13 may easily bypass the pushing member 12 in order to be injected into the ingredients compartment 11 by means of the holes or apertures generated therein.

After the generation of holes or apertures in the ingredients compartment 11 of the capsule, liquid under pressure is injected into the receiving chamber 13 by means of the liquid supply channel 15. Hence, pressure is build up within the receiving chamber 13 which leads to the injection of liquid into the capsule 1 by means of the recess 5 and the inner flow channels 4*c* provided in the opening means 4. The liquid injected into the ingredients compartment 11 is therefore made to interact with the ingredients provided therein. Due to the pressure-rise within the capsule, the outlet face 3*b* of the capsule is pressed against a relief 18 provided at the capsule holder 17. Accordingly, openings are produced in the outlet face 3*b* of the capsule 1.

Hence, when a sufficient pressure of liquid has been built up inside the capsule 1, the beverage produced due to an interaction between the injected liquid and the portioned ingredients provided within the ingredients compartment 11 can be drained from small interstices 19 provided between the relief members 18.

It should be noted that the opening means 4 of the capsule 1 can be provided with a one-way valve such as a rubber seal which opens when the piercing member is pushed or pressed down and/or water is injected into the recess and which closes the recess or holes when the pressure on the piercing member is released. Accordingly, no liquid is released from the capsule when the enclosing member 10 is disengaged from the capsule 1.

In addition, it should be understood that instead of a static or variable displaceable actuation member 12, the opening means 4 provided in the recess 5 of the capsule 1 may as well be actuated by the pressure of water being exerted thereon. Hence, no dedicated actuation member 12 has to be provided at the device side of the system.

FIG. 5*a* shows a preferred embodiment of the pushing member 12 according to the present invention. The cylindrically shaped pushing member 12 is preferably connected to a connecting member 20 which enables the connection of the pushing member 12 to the enclosing member 10 of the device. Thereby, the connecting member 20 comprises several outwardly bended portions 21 which engage by press-fitting in complementary recesses provided in the receiving chamber 13 (not shown). Thereby, the pushing member can be fixed in the receiving chamber 13 more easily during manufacture.

FIG. 5*b* shows another preferred actuation member 12 to be connected to a prior art device suitable for piercing an inlet face 3*a* of the capsule 1. Thereby, piercing blades 22 protrude from a base plate 23 to a predefined length L and hence, when connected to the device, the blades 22 protrude into the receiving chamber 13 of the device.

Such an actuation member 12 is particularly suitable for piercing prior art capsules made of plastic and/or aluminum. Moreover, such an actuation member 12 enables an interaction with opening means 4 of the capsule 1 according to the present invention since the protruding blades 23 are designed to engage within the recess 5 of the capsule 1 and hence, exert a force on the opening means 4 in order to pierce the ingredients compartment 11.

Although the present invention has been described with the reference to preferred embodiments thereof, many modifications and alternations may be made by a person of ordinary skill in the art without departing from the scope of this invention which is defined by the appended claims.

What is claimed is:

1. A capsule for containing beverage ingredients for the preparation of a beverage by injection of a liquid into the capsule, comprising:

a sealed ingredients compartment containing beverage ingredients;

an inlet face dedicated for injection of liquid into the capsule to form a beverage from the beverage ingredients;

an outlet face dedicated for delivery of the beverage; and an opening means which is positioned at the inlet face outside the ingredient compartment and which comprises a base member having a shape designed for contacting the inlet face and provided with a plurality of piercing members directed towards the sealed ingredients compartment for piercing the inlet face and having a size sufficient to extend into the ingredients compartments to facilitate entry of the liquid therein, wherein the base member of the opening means is formed as a partial or full ring with the piercing members spaced along the periphery of the partial or full ring.

2. The capsule according to claim 1, wherein the base member comprises at least two arc-shaped base elements.

3. The capsule according to claim 1, wherein the base member of the opening means is formed as a full ring with the piercing members spaced equidistantly along the periphery of the full ring.

4. The capsule according to claim 1, wherein the base member and piercing members are formed as an integral component and wherein the capsule is a sealed capsule and has a body made of plastic or metal.

5. A capsule for containing beverage ingredients for the preparation of a beverage by injection of a liquid into the capsule, comprising:

a sealed ingredients compartment containing beverage ingredients;

an inlet face dedicated for injection of liquid into the capsule to form a beverage from the beverage ingredients;

an outlet face dedicated for delivery of the beverage; and an opening means which is positioned at the inlet face outside the ingredient compartment and which comprises a base member having a shape designed for contacting the inlet face and provided with a plurality of piercing members directed towards the sealed ingredients compartment for piercing the inlet face and having a size sufficient to extend into the ingredients compartments to facilitate entry of the liquid therein, wherein the recess is an annular groove protruding inside the ingredients compartment of the capsule and the opening means is housed within the recess.

6. The capsule according to claim 5, wherein the opening means is configured and arranged to be moveable within the recess.

7. The capsule according to claim 5, wherein the opening means is initially secured within the recess by press-fitting or clipping but is designed to be movable when a certain pressure is exerted thereon.

8. The capsule according to claim 5, wherein the base member and piercing members are formed as an integral component.

9. The capsule according to claim 5, wherein the capsule is a sealed capsule and has a body made of plastic or metal.

10. A capsule for containing beverage ingredients for the preparation of a beverage by injection of a liquid into the capsule, comprising:

a sealed ingredients compartment containing beverage ingredients;

an inlet face dedicated for injection of liquid into the capsule to form a beverage from the beverage ingredients;

an outlet face dedicated for delivery of the beverage; and an opening means which is positioned at the inlet face outside the ingredient compartment and which comprises a base member having a shape designed for contacting the inlet face and provided with a plurality of piercing members directed towards the sealed ingredients compartment for piercing the inlet face and having a size sufficient to extend into the ingredients compartments to facilitate entry of the liquid therein, wherein the base member comprises a base ring and the piercing members are piercing blades or spikes arranged in spaced relation about the periphery of the base ring.

11. The capsule according to claim 10, wherein the piercing members include inner flow channels for establishing a fluid connection between the inlet face of the capsule and the ingredients compartment.

12. The capsule according to claim 11, wherein the piercing members further comprises outlet apertures which are designed to direct liquid provided to the flow channels into the ingredients compartment.

13. The capsule according to claim 11, wherein the flow channels are arranged to be essentially perpendicular to the capsule axis and the outlet apertures are arranged to direct the liquid in the channels in at least one radial direction relative to the channels.

14. The capsule according to claim 10, wherein the base member and piercing members are formed as an integral component and wherein the capsule is a sealed capsule and has a body made of plastic or metal.

15. A capsule for containing beverage ingredients for the preparation of a beverage by injection of a liquid into the capsule, comprising:

a sealed ingredients compartment containing beverage ingredients;

an inlet face dedicated for injection of liquid into the capsule to form a beverage from the beverage ingredients;

an outlet face dedicated for delivery of the beverage; and an opening means which is positioned at the inlet face outside the ingredient compartment and which comprises a base member having a shape designed for contacting the inlet face and provided with a plurality of piercing members directed towards the sealed ingredients compartment for piercing the inlet face and having a size sufficient to extend into the ingredients compartments to facilitate entry of the liquid therein, wherein the opening means comprises a valve which is designed to open or close the inner flow channels as a result of the pressure or force being exerted thereon.

16. The capsule according to claim 15, wherein the base member and piercing members are formed as an integral component and wherein the capsule is a sealed capsule and has a body made of plastic or metal.

17. A system for preparing a beverage from a food substance contained in a ingredients compartment of a rigid capsule by injection of a liquid into a capsule comprising:

a sealed ingredients compartment containing beverage ingredients;

an inlet face dedicated for injection of liquid into the capsule to form a beverage from the beverage ingredients;

an outlet face dedicated for delivery of the beverage; and an opening means which is positioned at the inlet face outside the ingredient compartment and which comprises a base member having a shape designed for contacting the inlet face and provided with a plurality of piercing members directed towards the sealed ingredients compartment for piercing the inlet face and having a size sufficient to extend into the ingredients compartments to facilitate entry of the liquid therein, with the system comprising:

a device having at least one enclosing member connected to a closing mechanism for selectively enclosing the capsule in a receiving chamber of the device;

a liquid reservoir;

a pump connected to the liquid reservoir for supplying liquid to the receiving chamber, and dedicated actuation means connected to the enclosing member for actuating the opening means of the capsule.

18. The system according to claim 17, wherein the actuation means of the device comprises a pushing member which is designed to engage in an annular recess of the capsule in which the opening means of the capsule are disposed due to a relative movement of the capsule and the enclosing member.

19. The system according to claim 17, wherein the actuation means of the device is designed to exert a pressure onto the opening means of the capsule by the effect of liquid under pressure being provided to the inlet face of the capsule.

* * * * *